US005354172A

United States Patent [19]

Schofield

[11] Patent Number: 5,354,172

[45] Date of Patent: Oct. 11, 1994

[54] MOLECULAR DRAG VACUUM PUMP

[75] Inventor: Nigel P. Schofield, Horsham, England

[73] Assignee: The BOC Group plc, Windlesham, England

[21] Appl. No.: 985,473

[22] Filed: Dec. 3, 1992

[30] Foreign Application Priority Data

Dec. 4, 1991 [GB] United Kingdom ..... 9125848.3

[51] Int. Cl.[5] ..... F01D 1/36

[52] U.S. Cl. ..... 415/90; 417/423.4

[58] Field of Search ..... 415/90, 200; 416/201 R, 416/201 A; 417/423.4

[56] References Cited

U.S. PATENT DOCUMENTS 3,628,894 12/1971 Ferguson, Jr. .
4,389,119 6/1983 Valsamis et al. ..... 415/90

FOREIGN PATENT DOCUMENTS 2034285 1/1972 Fed. Rep. of Germany .
3402548 1/1985 Fed. Rep. of Germany .
408840 4/1910 France .
1594593 8/1970 France .
2199386 5/1974 France .
0567848 3/1976 U.S.S.R. ..... 415/90
0649885 2/1979 U.S.S.R. ..... 415/90
1232851 5/1986 U.S.S.R. ..... 415/90
1366711 1/1988 U.S.S.R. ..... 415/90
1437577 11/1988 U.S.S.R. ..... 415/90
1248031 9/1971 United Kingdom .

OTHER PUBLICATIONS

Harris, Nigel S., *Modern Vacuum Practice,* 1989, pp. 146–151.

*Primary Examiner*—Edward K. Look
*Assistant Examiner*—Mark Sgantzos
*Attorney, Agent, or Firm*—David M. Rosenblum; Larry R. Cassett

[57] ABSTRACT

A vacuum pump of the molecular drag type comprising a pump body, a cylindrical element adapted for rotation within the pump body about its longitudinal axis and having a plurality of circumferential slots defined in its surface which are substantially perpendicular to the longitudinal axis, a stator element held stationary with regard to the pump body and having projections extending into the slots substantially to fill the slots in the vicinity of the stator, wherein at least some of the surfaces of the stator projections adjacent the walls of the slots are coated with an abradable material.

5 Claims, 1 Drawing Sheet

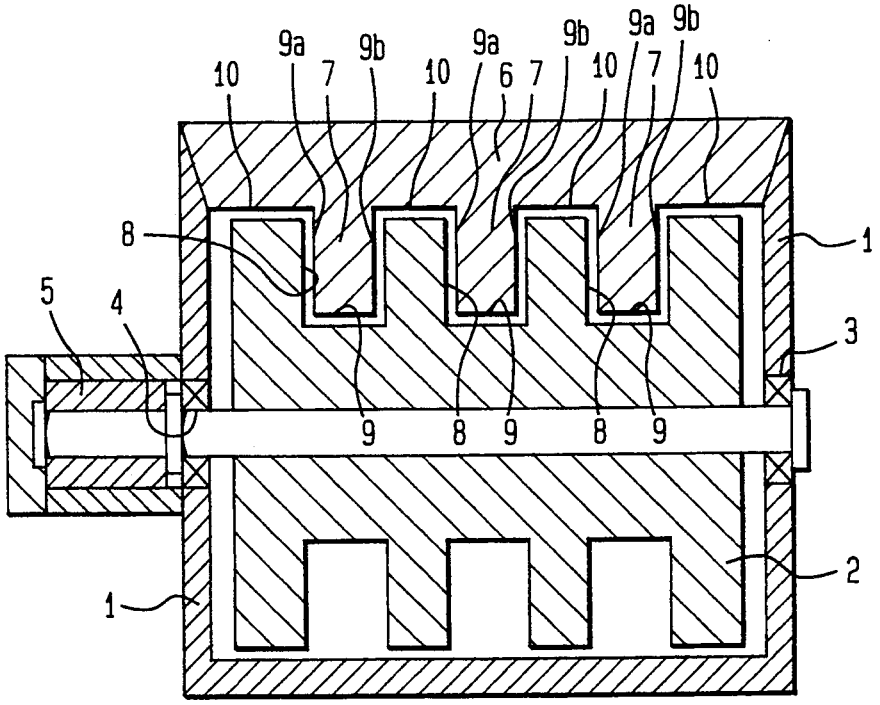
9a
9b
9a
9b
9a
9b
10
7
10
6
7
10
7
10
8
1
5
4
3
9
8
9
8
9
2
1

MOLECULAR DRAG VACUUM PUMP

BACKGROUND OF THE INVENTION

This invention relates to vacuum pumps and more particularly to those pumps known as molecular drag pumps.

Molecular drag pumps operate on the general principle that, at low pressures, gas molecules striking a fast moving surface can be given a velocity component from the moving surface. As a result, the molecules tend to take up the same direction of motion as the surface against which they strike, thus urging the molecules through the pump leaving a relatively lower pressure in the vicinity of the pump inlet.

Vacuum pumps operating on the basis of this principle were proposed circa 1910 by Gaede. They generally comprised a cylinder adapted for rotation within a pump body and having a plurality of parallel slots, around its circumference. A stator element, sometimes referred to as a "comb", is supported within the body at one side of the pump and having parallel projections which fit closely within the slots, typically with a 0.1 mm clearance on all sides.

A pressure gradient is therefore established across the stator element with lower pressure on the upstream side and higher pressure on the downstream side. A pump inlet is positioned at the lower pressure side of the stator and an outlet at the higher pressure side and generally a separate pump, for example an oil pump, is connected to the outlet.

Generally the speeds of rotation of the cylinder are high, for example up to ten thousand revolutions/minute or more.

The invention is concerned with an improved pump design associated in particular with the provision and maintenance of the small clearance required between the cylindrical element slots and the stator.

SUMMARY OF THE INVENTION

In accordance with the invention, there is provided a vacuum pump of the molecular drag type comprising a pump body (or stator), a cylindrical element adapted for rotation within the pump body about its longitudinal axis and having a plurality of circumferential slots defined in its surface which are substantially perpendicular to the longitudinal axis, a stator element held stationary with regard to the pump body and having projections extending into the slots substantially to fill the slots in the vicinity of the stator element, wherein at least some of the surfaces of the stator projections adjacent the walls of the slots are coated with an abradable material.

The surfaces of the projections which should advantageously be coated are those which are adjacent the side walls of the slots. The ends of each projection, i.e. adjacent the bottom of each slot may also usefully be coated with the abradable material. That part of the stator between each projection and which may contact the outer ends of the cylindrical element can also be coated if desired.

The abradable material may be of any suitable composition that can be satisfactorily coated onto the stator projections and form a good contact therebetween. Preferably, the coating is pertetrafluoroethylene (PTFE) which can be readily sprayed onto the relevant surfaces of the stator.

Alternatively, the coating may be a pre-formed piece of abradable material which is fitted tightly to the stator surface. Again this pre-formed piece may be of PTFE; alternative polymer based materials may be employed.

Generally, the cylindrical element may be manufactured from a single block of material, for example of aluminium or an aluminium alloy with the slots being machined from the block.

The cylindrical element must be mounted for rotation about its longitudinal axis in a manner which allows for a fast rate of rotation and for an accurate positioning (and maintenance therein) of the axis of rotation. This can be achieved by mounting the cylindrical element on a shaft and providing a mounting of the shaft within the pump body using suitable bearings, etc.

The stator element can usefully take the form of a "comb" whose teeth represent the projections which extend into the slots of the cylindrical element. The stator element must be mounted relative to the pump body that it can be fixed in position with as small as possible a clearance between the projections and the surface walls of the slot.

With the relevant parts of the stator or comb teeth coated with the abradable substance in accordance with the invention, the stator projections can be positioned very closely to the walls of the slots in the cylindrical element within the pump body. The presence of the abradable substance thereafter allows a fine clearance to be set in situ (without danger of the pump seizing) by allowing the cylindrical element in use of the pump to abrade the coating to take account of:

a) any imperfections in the cylindrical element itself or its mode of mounting/rotation within the pump body b) any change of dimensions due, for example, to thermal expansion or atmospheric loading.

BRIEF DESCRIPTION OF THE DRAWING

For a better understanding of the invention, reference will now be made, by way of exemplification only, to the accompanying drawing which shows a schematic sectional view through a vacuum pump of the invention.

DETAILED DESCRIPTION

With reference to the drawing, there is shown therein a sectional view through a pump of the invention in a schematic manner; there would in particular commonly be more slots/projections in the pumps.

The pump shown therein comprises a body 1 within which is mounted a cylindrical element 2 manufactured from an aluminium alloy. The cylindrical element 2 is rotatable within bearings 3,4 about its longitudinal axis by means of a motor 5 at very high speeds, for example in excess of ten thousand revolutions per minute.

Contained within the body is a comb-like stator element 6 having a series of projections 7 which extend into circumferential slots 8 found in the surface of the cylindrical element 2. The side surfaces 9A and 9B of the projections 7 are each coated with a layer of PTFE as are the end surfaces 9 of the projections 7 of the comb-like stator element 6 connecting side surfaces 9A and 9B. Additionally intermediate circumferential surfaces 10 located between projection 7 are also coated with a layer of "PTFE".

In assembling the pump, the comb-like stator element 6 is accurately positioned relative to the cylindrical element such that the projections 7 and side and end surfaces 9A, 9B, and 9, respectively, form a very fine clearance with the complementary side and walls and surfaces of the defining slots 8 of the cylindrical element. A manual adjustment of the comb is generally possible within the pump body to achieve this.

In use of the pump, rotation of the cylindrical element 2 relative to the comb-like stator element 6 allows the fine clearance therebetween to be maintained with any tendency for contact between the comb and the rotating cylindrical element to be countered by wear of the relevant part of the PTFE coating, thereby avoiding the possibility of seizure of the pump through such contact.

I claim:

1. A vacuum pump of the molecular drag type comprising a pump body, a cylindrical element for rotation within the pump body about its longitudinal axis and having a plurality of circumferential slots defined in its surface which are substantially perpendicular to the longitudinal axis, a comb-like stator element held stationary with regard to the pump body and having projections extending into the slots substantially to fill the slots with a sufficiently fine clearance that possible contact exists between the projections and the cylindrical element, each of said projections having opposed side surfaces and an end surface connecting said side surfaces, said side and end surfaces of said projections located adjacent complimentary side and end surfaces defining said slots, and an abradable material coating said side surfaces of said projections so that said abradable material wears upon the possible contact between said projections and said cylindrical element.

2. A vacuum pump according to claim 1 in which the end surfaces of said projections are also coated with the abradable material.

3. A vacuum pump according to claim 1 in which said stator has intermediate circumferential surfaces located between said projections and said intermediate circumferential surfaces are also coated with said abradable material.

4. A vacuum pump according to claim 1 in which the abradable material is PTFE.

5. A vacuum pump according to claim 1 in which the abradable material coating comprises the abradable material fitted to the stator surface.

* * * * *